US008936148B2

(12) United States Patent
Olsen

(10) Patent No.: US 8,936,148 B2
(45) Date of Patent: Jan. 20, 2015

(54) CONTAINER CARRIER

(71) Applicant: Robert C. Olsen, Medinah, IL (US)

(72) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/801,351

(22) Filed: Mar. 13, 2013

(65) Prior Publication Data

US 2014/0021072 A1 Jan. 23, 2014

Related U.S. Application Data

(60) Provisional application No. 61/673,108, filed on Jul. 18, 2012.

(51) Int. Cl.
*B65D 75/00* (2006.01)
*B65D 71/00* (2006.01)
*B65D 71/50* (2006.01)

(52) U.S. Cl.
CPC ..... *B65D 71/00* (2013.01); *B65D 71/504* (2013.01)
USPC ..... 206/150; 294/87.2

(58) Field of Classification Search
USPC ..... 206/149–153, 427, 161, 162; 294/87.2
See application file for complete search history.

(56) References Cited

U.S. PATENT DOCUMENTS

| | | | | |
|---|---|---|---|---|
| 5,305,877 | A | 4/1994 | Olsen | |
| 5,642,808 | A * | 7/1997 | Marco et al. | 206/150 |
| 5,806,667 | A * | 9/1998 | Marco | 206/150 |
| 6,779,655 | B2 * | 8/2004 | Olsen et al. | 206/150 |
| 7,387,201 | B2 * | 6/2008 | Olsen et al. | 206/150 |
| 7,510,075 | B2 * | 3/2009 | Olsen et al. | 206/150 |
| 7,793,778 | B2 | 9/2010 | Olsen | |
| 2004/0004365 | A1 * | 1/2004 | Olsen | 294/87.2 |
| 2004/0055905 | A1 * | 3/2004 | Marco et al. | 206/150 |
| 2005/0241963 | A1 * | 11/2005 | Slomski | 206/150 |
| 2006/0196782 | A1 * | 9/2006 | Olsen et al. | 206/150 |
| 2009/0223171 | A1 | 9/2009 | Olsen | |

FOREIGN PATENT DOCUMENTS

| | | | |
|---|---|---|---|
| EP | 0 678 456 | A1 | 10/1995 |
| WO | WO 2009/029814 | A1 | 3/2009 |

* cited by examiner

*Primary Examiner* — Luan K Bui
(74) *Attorney, Agent, or Firm* — Pauley Petersen & Erickson

(57) ABSTRACT

A container carrier for unitizing a plurality of containers that includes two layers of a flexible sheet joined along a weld and two rows of container receiving apertures formed in the carrier and generally separated by the weld wherein each container receiving aperture forms an interruption in the weld. One or more tabs may extend from an edge of each container receiving aperture into the container receiving aperture to minimize movement and contact between adjacent containers in the resulting package.

14 Claims, 2 Drawing Sheets

CONTAINER CARRIER

This application claims benefit of 61/673,108, filed on Jul. 18, 2012.

BACKGROUND OF THE INVENTION

1. Field of the Invention

This invention relates to a flexible carrier for carrying a plurality of containers such as bottles.

2. Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extend upwardly from the carrier to enable a consumer to carry the package.

Up until now, plastic ring carriers have generally been avoided by the glass industry because bottles tend to clang or bang against one another when shipped or lifted. This problem is typically due to spacing that existing plastic ring carriers create between containers when applied. This gives consumers a perception that bottles will break as a result of the contact. In the past, efforts to remedy this issue include using a thin plastic sleeve around an outside of the package which compresses the containers in the multipack thus avoiding the clanging noise entirely. The problem with this remedy is that it involves another applicating machine as well as the added cost of the sleeve itself.

The present invention efforts to accomplish the beneficial effects of a compressed package that was previously possible only by adding a sleeve.

SUMMARY OF THE INVENTION

The present invention is directed to a flexible carrier for packaging containers that includes an arrangement of a handle extending upwardly between adjacent rows of container receiving apertures such that the resulting package is lifted from the top (a "top-lift" carrier). As described, a particular arrangement of the carrier results in a tight package with a configuration among and between adjacent containers which minimizes or eliminates bottle-to-bottle contact.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

FIGS. 1-4 show flexible carrier 10 for unitizing four, six or eight or more containers and a resulting unitized package.

Although FIGS. 1-4 illustrate various structures for flexible carrier 10 of the invention, the illustrations are exemplary, and the invention is not limited to the flexible carriers 10 or packages shown. For example, flexible carrier 10 may be alternatively configured and used to unitize ten, fourteen or any other desired number of containers.

Containers (not shown) are preferably bottles, and more preferably are glass bottles, however any other commonly unitized container may be used with flexible carrier 10 according to this invention. The containers are preferably, though not necessarily, like-sized within a single flexible carrier 10. The flexible carrier 10 is intended for glass bottles of almost any size but primarily intended for 6 oz. to 20 oz. The subject invention seeks to minimize or totally eliminate bottle to bottle contact when being handled by the merchandiser or consumer.

Figure 3:
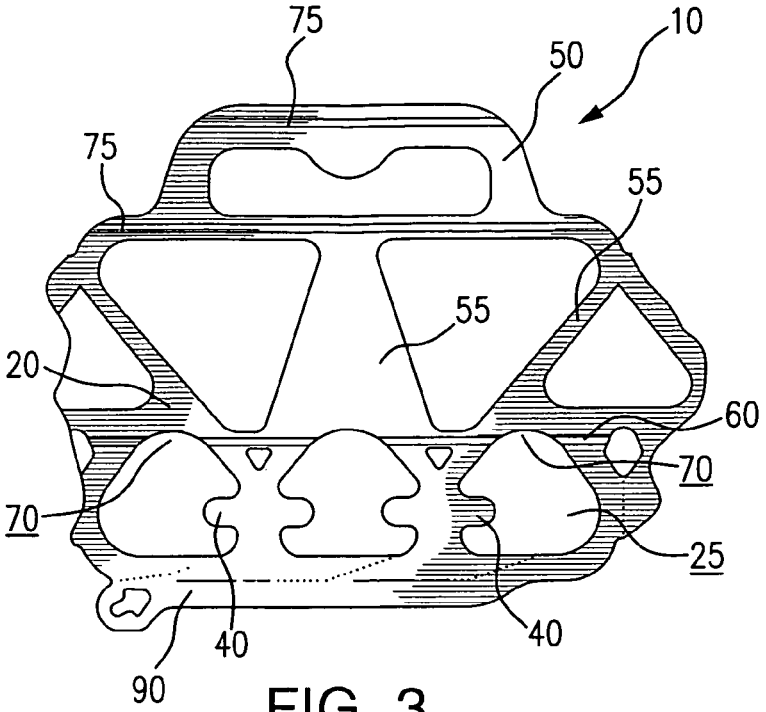
FIG. 3 is a side elevational view of a package of containers according to one preferred embodiment of this invention.
Figure 4:
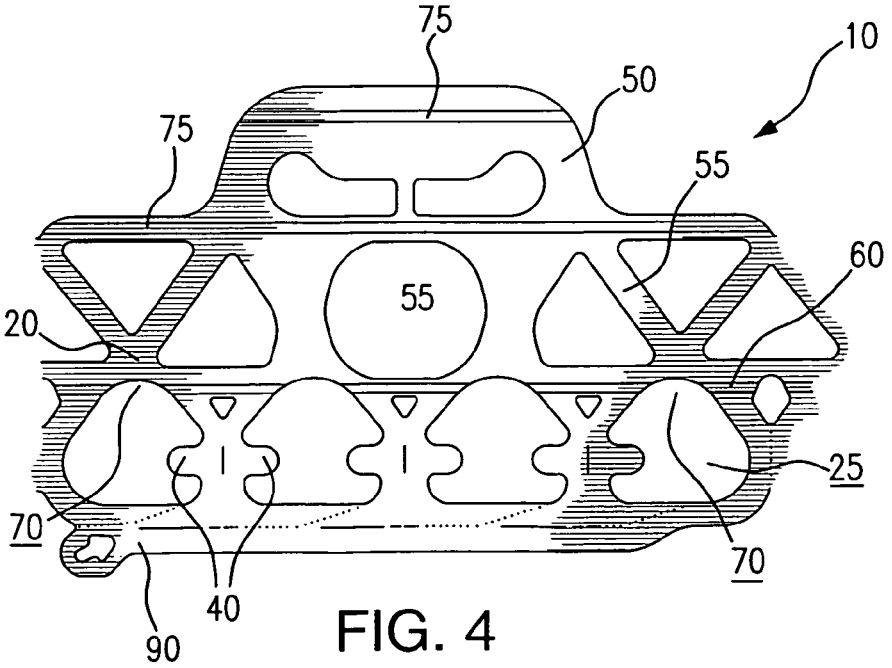
FIG. 4 is a side elevational view of a package of containers according to one preferred embodiment of this invention.

Each flexible carrier 10 preferably includes one or more layers of flexible sheet 20 having a width and length defining therein a plurality of container receiving apertures 25, each for receiving a container. The plurality of container receiving apertures 25 are preferably arranged in longitudinal rows and longitudinal ranks so as to form an array of container receiving apertures 25, such as two rows by three ranks for a six container multipackage (a "six pack") as shown in FIG. 3. Container receiving apertures 25 are preferably arcuate toward a center of the flexible carrier and generally straight along an outer portion of flexible carrier 10.

According to one preferred embodiment of this invention, such as shown in FIGS. 1-4, two layers of flexible sheet 20 are connected along a longitudinally extending centerline 60. Centerline 60 as used herein generally describes a segment between rows of container receiving apertures 25 and/or between layers of flexible sheet 20. According to one preferred embodiment of this invention, centerline 60 comprises a weld that joins the two layers of flexible sheet 20. The two layers of flexible sheet 20 may be coextruded, welded, or otherwise joined together to create flexible carrier 10. A "weld" as used in the specification and claims may be defined as a hot weld, cold weld, lamination or any other manner of connection that joins two sheets of material known to those having ordinary skill in the art.

Figure 1:
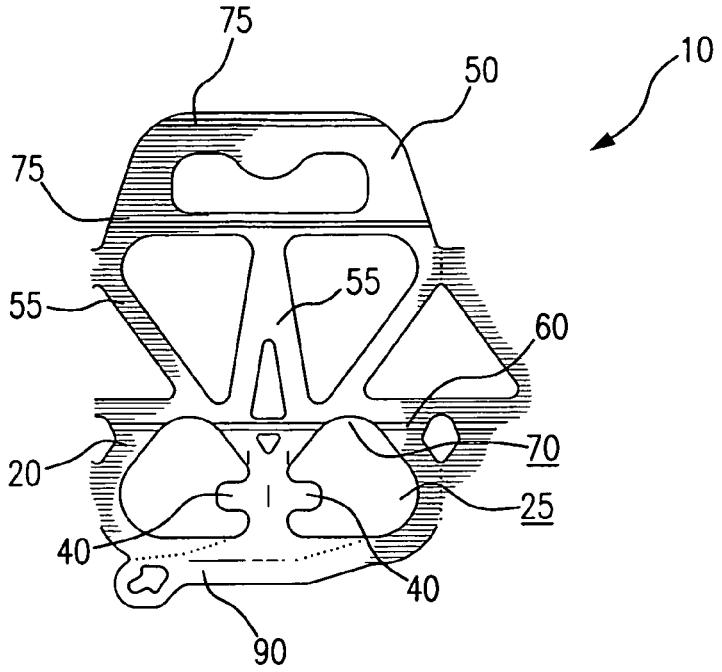
FIG. 1 is a side elevational view of a flexible carrier according to one preferred embodiment of this invention.
Figure 2:
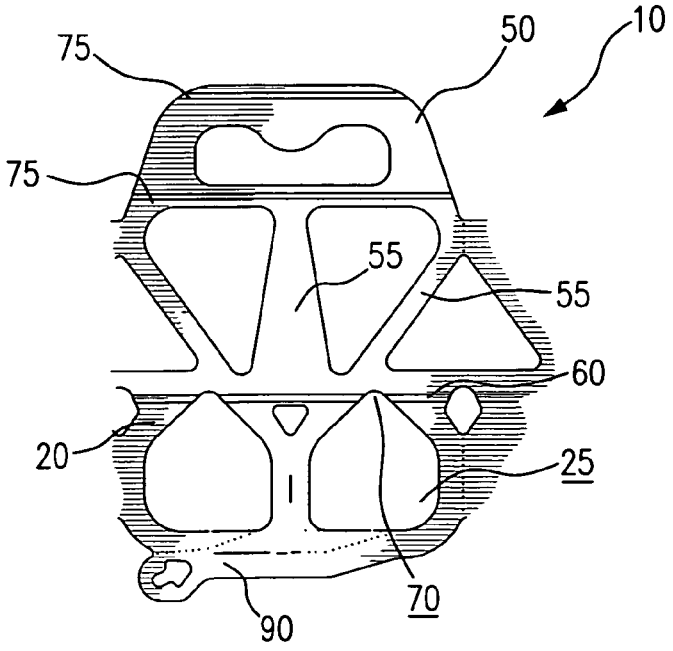
FIG. 2 is a side elevational view of the flexible carrier of FIG. 1 in an opened position.

As shown in FIGS. 1-3, a row of container receiving apertures 25 is preferably mostly formed on each side of centerline 60 and/or in each layer of the two layers of flexible sheet 20. As such, one row of container receiving apertures 25 is preferably mostly formed along each side of the centerline 60. Accordingly, four container receiving apertures 25 are formed in flexible carrier 10 shown in FIG. 1, i.e. two overlapping rows of two container receiving apertures 25 each. Container receiving apertures 25 are preferably formed in a geometry that results in a tight unitization of containers without excess play and/or sliding between and among containers and flexible carrier 10.

According to a preferred embodiment of this invention, container receiving apertures 25 preferably extend into the centerline 60 or lamination along an inner portion of flexible carrier 10 so that there is minimal material between the bottles in an area where they contact one another. Specifically, as shown in FIGS. 1-4, interruptions 70 are formed in the centerline 60 as a result of an extremity of each container receiving aperture 25 extending beyond centerline 60. Following application to respective bottles, container receiving apertures 25 preferably include a degree of elongation such that the bottles are compressed together very tightly in a transverse or widthwise direction of the flexible carrier 10. This compression results in a desired little or no space between bottles in the package.

In addition, tabs 40 are preferably formed to extend within the container receiving apertures 25. Such tabs 40 preferably extend in the longitudinal machine direction, or lengthwise, along the flexible carrier 10. Such tabs 40 preferably abut respective containers within the package and help absorb the shock when the unitized package is lifted. These tabs 40 may be formed in a desired length to protect adjacent containers from contacting each other along respective mid-sections. Such tabs 40 are preferably uncut and otherwise free of slit, perforations, etc. to provide such cushion within the container receiving apertures 25. According to one preferred embodiment of the invention shown in FIGS. 2 and 4, a slit is formed in a web of the container carrier 10 between adjacent tabs 40.

Additional tabs 40 may be added to ends and sides of individual container receiving apertures 25 to protect one package from another during shipment in trays of full wraps. However, tabs 40 are preferably only formed in the region between adjacent container receiving apertures 25. As such, end container receiving apertures 25 will generally only include a single tab 40 and central container receiving apertures 25 will include two tabs 40.

As shown in FIGS. 1-4, according to one preferred embodiment of this invention, a handle 50 is formed along the centerline 60 between the two rows of container receiving apertures 25 and, following application to containers, in a separate plane from the two rows of container receiving apertures 25. Specifically, as shown in FIGS. 1-4, the handle 50 is connected along a side of the row of container receiving apertures 25, and is preferably connected with respect to centerline 60, such as a lamination. The handle 50 may be integrally formed with flexible sheet 20 or may be separately formed and attached relative to flexible sheet 20.

The handle 50 may comprise one or more elongated apertures 55 positioned along the outer periphery of handle 50 or may comprise a similar configuration that provides an ample area for a consumer to grasp by inserting his hand through and still maintain the purpose and integrity of package.

The handle 50 preferably includes struts 55 which are designed such that the bottles cock inward at a neck area when lifted. This permits the tabs 40 to dampen shock by providing a media for the bottles to compress into. The struts 55 are preferably formed in both layers of flexible sheet 20 and one or more handle welds 75 may be positioned longitudinally across handle 50.

The package resulting from flexible carrier 10 includes a plurality of unitized containers. Flexible carriers 10 are generally applied to containers by stretching flexible sheet 20 surrounding container receiving apertures 25 around container 80, and requiring the stretched carrier 10 to recover, thereby providing a tight engagement.

As a result of the described configuration in one preferred embodiment of this invention, two layers of flexible sheet 20 joined with the longitudinally extending centerline 60 include a row of container receiving apertures 25 formed in each layer of the two layers of flexible sheet 20. One row of container receiving apertures 25 is formed on each side of centerline 60 resulting in flexible carrier 10 fanning out at centerline 60 to permit a generally flat plane of engagement within which containers are inserted. Handle 50 preferably extends in a different plane from flexible sheet 20 in this configuration at application. In this manner, each row of container receiving apertures 25 engages a respective row of containers to form package. Further, as extremities of the container receiving apertures 25 extend through the centerline 60, transversely adjacent bottles are held in tight engagement relative to each other thereby reducing bottle movement and clanking when carried.

A tear strip 90 may be positioned along each row of containers and container receiving apertures 25 to permit removal of individual containers from the package following application. The tear strip 90 may include a finger hold and one or more slits and/or perforations to permit removing a portion of the container carrier to tear, expose or weaken an area around the containers thereby permitting removal.

While in the foregoing specification this invention has been described in relation to certain preferred embodiments thereof, and many details have been set forth for purpose of illustration, it will be apparent to those skilled in the art that flexible carrier 10 and package are susceptible to additional embodiments and that certain of the details described herein can be varied considerably without departing from the basic principles of the invention.

The invention claimed is:

1. A container carrier for unitizing a plurality of containers, the container carrier comprising:

two layers of a flexible sheet joined along at least one welded centerline;

a plurality of container receiving apertures formed in two rows, one row on each side of the centerline, wherein an extremity of each container receiving aperture extends through the at least one welded centerline thereby forming two or more interruptions in the at least one welded centerline.

2. The container carrier of claim 1 further comprising:

one or more tabs extending from an edge of each container receiving aperture into the container receiving aperture.

3. The container carrier of claim 2 wherein the tabs extend longitudinally.

4. The container carrier of claim 2 wherein the tabs are uncut.

5. The container carrier of claim 4 wherein a slit is formed in a web between adjacent tabs.

6. The container carrier of claim 2 wherein one tab is formed in each end container receiving aperture and two tabs are formed in each central container receiving aperture.

7. The container carrier of claim 1 further comprising:

a handle extending upwardly from the at least one welded centerline.

8. The container carrier of claim 1 further comprising:

a directional tear strip extending at least partially across a length of the container carrier.

9. A container carrier for unitizing a plurality of containers comprising:

two layers of a flexible sheet joined along a weld;

two rows of container receiving apertures formed in the carrier and generally separated by the weld wherein each container receiving aperture forms an interruption in the weld; and one or more tabs extending from an edge of each container receiving aperture into the container receiving aperture.

10. The container carrier of claim 9 wherein a tab of the one or more tabs is formed in an area of each container receiving aperture that is directly adjacent to another container receiving aperture.

11. The container carrier of claim 10 wherein the tab of the one or more tabs is uncut.

12. The container carrier of claim 9 wherein one tab of the one or more tabs is formed in each end container receiving aperture and two tabs of the one or more tabs are formed in each central container receiving aperture.

13. The container carrier of claim 9 further comprising:

a handle extending upwardly from the weld.

14. The container carrier of claim 13 further comprising:

two or more handle struts connected between the handle and the weld.

* * * * *